United States Patent [19]

Bintner et al.

[11] Patent Number: 4,570,858

[45] Date of Patent: Feb. 18, 1986

[54] COATED SPRAY NOZZLE TIPS

[75] Inventors: Dennis W. Bintner; Joseph B. Ryan, Jr., both of Des Moines, Iowa; Mark H. Bartel, Lexington, Tenn.

[73] Assignee: Delavan Corporation, West Des Moines, Iowa

[21] Appl. No.: 457,196

[22] Filed: Jan. 11, 1983

[51] Int. Cl.[4] ..... B05B 1/00

[52] U.S. Cl. ..... 239/390; 239/71

[58] Field of Search ..... 239/390, 599, 602, 523, 239/71, 589; 101/41-44, DIG. 16

[56] References Cited

U.S. PATENT DOCUMENTS

| | | | |
|---|---|---|---|
| 2,915,926 | 12/1959 | Woerner | 239/71 |
| 3,779,462 | 12/1973 | Bruninga | 239/230 |
| 4,077,319 | 3/1978 | Edmisten | 101/41 |
| 4,130,247 | 12/1978 | Healy | 239/523 |

FOREIGN PATENT DOCUMENTS

| | | | |
|---|---|---|---|
| 403625 | 12/1933 | United Kingdom | 239/71 |
| 826273 | 12/1959 | United Kingdom | 101/DIG. 16 |
| 617110 | 7/1978 | U.S.S.R. | 101/42 |

*Primary Examiner*—Andres Kashnikow
*Assistant Examiner*—Daniel R. Edelbrock
*Attorney, Agent, or Firm*—Lockwood, Alex, FitzGibbon & Cummings

[57] ABSTRACT

A metal spray tip for a fluid spray nozzle and a method of making such tip includes adhering a colored coating so as to cover at least a portion of the exterior surface of the spray tip adjacent the spray orifice in the tip. In one embodiment, the entire tip blank is first coated and then the orifice is formed in the coated blank to free the orifice of the coating and expose the metal of the tip at the orifice. In another embodiment, the orifice is first formed in a face of the tip and the tip face containing the orifice is then printed with the coating. In the latter embodiment, preferably only a portion of the exterior surface of the tip is coated to leave the metal exposed on some portions of the exterior surface. In still another embodiment of tip, a substantially flat exterior face of the tip which does not contain the orifice may be coated.

8 Claims, 13 Drawing Figures

FIG. 5
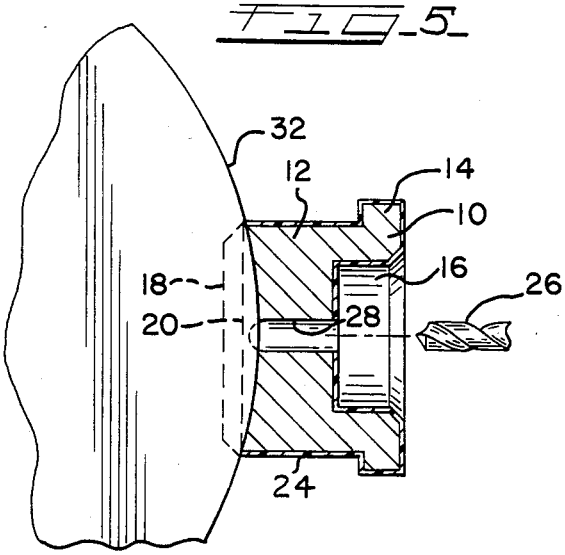
FIG. 6
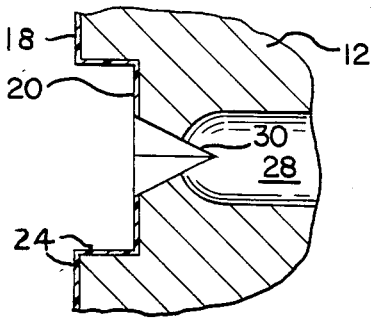
FIG. 7
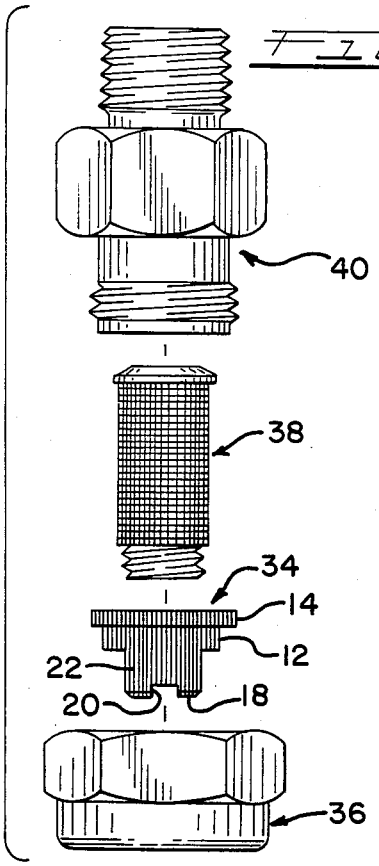
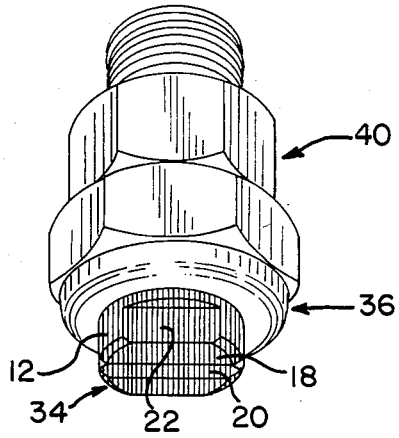
FIG. 8

FIG. 9A
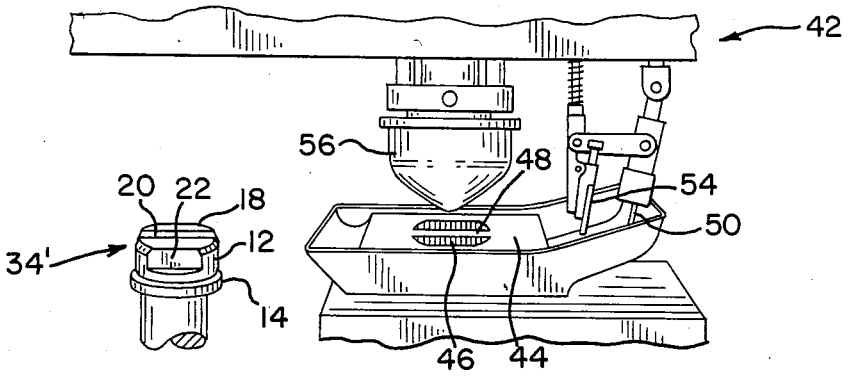
FIG. 9B
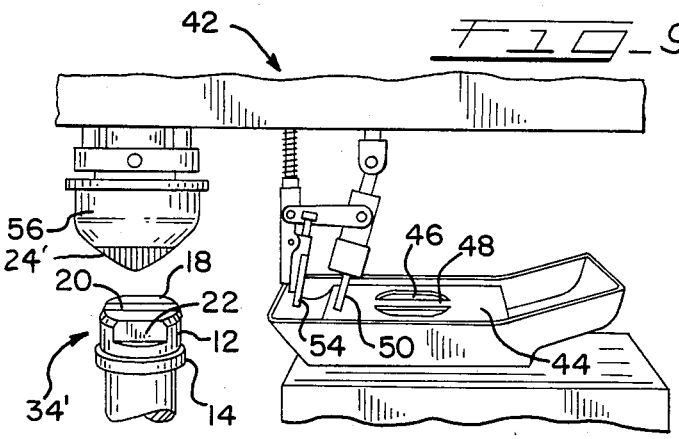
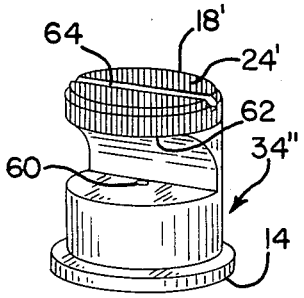
FIG. 11
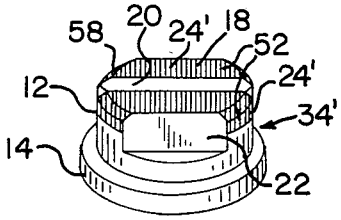
FIG. 10
FIG. 9C
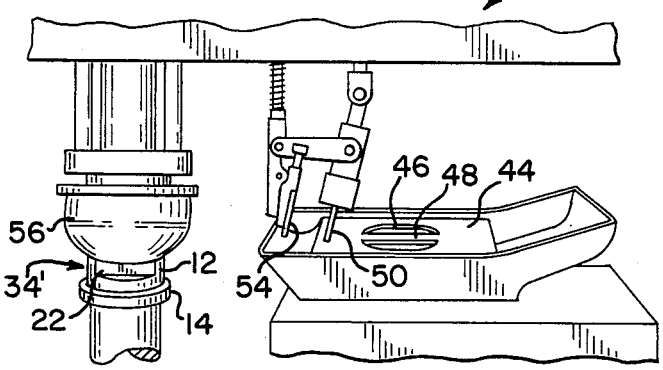

COATED SPRAY NOZZLE TIPS

BACKGROUND AND SUMMARY OF THE INVENTION

The present invention relates to a spray tip and a method of forming a spray tip and, in particular, to a metal spray tip for a fluid spray nozzle and method of forming such tip in which at least a portion of the exterior surfaces of the spray tip are coated with a colored coating.

Spray tips having a wide variety of sizes and shapes of spray orifices and, hence, a wide range of flow rates, have been employed in a vast range of differing uses. Such tips are generally installed in nozzle bodies which hold the tip and transmit the fluid to be sprayed thereto where the orifice meters the fluid and shapes the spray discharge into its desired shape and patternation. Thereby, the tip orifice actually determines the flow rate of the nozzle at any given fluid pressure, and in a given use, such as in the spraying of agricultural chemicals, a particular tip having a given sized metering orifice is selected for use in these nozzle bodies depending upon the flow rate desired by the user for that particular use.

Such spray tips are frequently quite small and, as a result of their size, are either incapable of carrying adequate markings on the tip itself which might visually indicate the capacity of a given tip or, if such markings can be carried on the tip, they either must be in a short code or are frequently so small as to be difficult to visually observe. It is also a frequent occurrence that markings, if they are present on the tip, are obscured by the nozzle body itself after the tip is installed in the nozzle body or by the liquid being sprayed during use. Thus, it is usually difficult, if not impossible, to visually determine just what the flow rate is of a given nozzle even if the spray tip is marked without either disassembling the nozzle body or subjecting the person making that determination to contact with the fluid which is being sprayed.

In order to overcome these aforementioned identification difficulties, several approaches have been employed in the past which involve color coding either the spray tips or some portion of the nozzle body for rapid identification of the flow rates of given tips or nozzle assemblies.

One manner of color coding comprises wrapping tape about either the nozzle body or the nozzle tip in a recess or recesses therein. The disadvantage of this method of identification is that the tape tends to loosen and become lost in use and recesses may be difficult to form in extremely small nozzle tips.

Another method of color coding consists of molding the entire nozzle tip of a colored plastic material. Although this method overcomes the difficulty of loss of the color identification in use and lack of availability of space for color coded recesses, the plastic has certain inherent disadvantages over metals, such as brass or steel. For example, the use of plastic requires special machinery to replace the machinery previously conventionally used for the forming of metal spray tips, custom making of tips to order is generally more difficult than with metal tips, and durability may not be as good in some plastic tips as in metal tips. Moreover, the precision of some plastic tips may not be as good as the corresponding machined metal tip.

Other color coding methods have also included the painting of colored dots on portions of the nozzle assembly other than the spray tip itself, for example on the tip retainer ring. One of the disadvantages of this procedure is that the color coding is effective only so long as care is taken to change the retainer ring at the same time as the nozzle tip. If the retainer ring is not changed when a tip is changed to a different flow rate, the coding on the nozzle is no longer indicative of the flow rate on the actual tip then being used in the nozzle and the coding, in fact, actually becomes misleading.

The spray tips and methods of forming the tips of the present invention overcome these several disadvantages. In the present invention a nozzle spray tip may be formed of metal, thereby, realizing all of the inherent advantages of metal. Yet, such metal tips may be color coded so as to give a ready indication of the flow rate of the spray tips to an observer having knowledge of the code. Because the spray tip of the present invention may be formed of metal, special machinery to form the tip is not necessary, custom making of the tips is facilitated, and durability and precision of the spray tips in use may be improved. Moreover, the spray tip incorporating the principles of the invention itself is coated with a color coating and, thereby, the identification of the flow rate of that given tip is always accurate in whatever nozzle assembly the tip may be installed. Either the relationship of the flow rates of a plurality of spray tips in a given installation, e.g. an agricultural spray boom, or the flow rate of any given spray tip of the present invention may be readily determined by visual examination, either before installation of the tips or after the tips are in use, and without exposure of the investigator to contamination from the fluid being sprayed. The ability to readily visually determine the flow rate of the nozzles in, for example apparatus for the application of agricultural herbicides and pesticides, can have an added environmental advantage in reducing the amount of such materials which might otherwise enter the environment due to the use of improper oversized tips in such apparatus.

Additionally, in a spray tip incorporating the principles of the present invention, the colored coating on the tip does not impair the precision of the tip and, in some of the preferred embodiments of the tip of the present invention, the metal tip may be coated after it is fully formed with its spray orifice. The ability to coat the tip after the orifice is formed, may eliminate the need for baking to cure the coating, reduce the thickness of the coating, reduce the tendency of the coating to flake or peel, facilitate identification of the nature of the metal used to form the tip both during and after coating has occurred, and facilitate the removal of burrs and cleaning after machining of the tip without damaging the coating.

In one principal aspect of the present invention, a spray tip for a fluid spray nozzle having a spray orifice therein for metering and spraying fluid is provided. The improvement in such tip comprises a colored coating adhering to and covering at least a portion of the exterior surface of the tip adjacent to the spray orifice.

In another principal aspect of the present invention, in the aforementioned spray tip the color of the coating denotes the flow rate of the spray tip.

In still another principal aspect of the present invention, the aforementioned spray tips include a face having the spray orifice therein and the face has the colored coating adhering thereto.

In still another principal aspect of the present invention, the exterior surfaces of the spray tip may be either completely coated or only partially coated so as to expose the material from which the tip is made to visual viewing.

In still another principal aspect of the present invention, the coating may be either an electrostatically deposited or a printed coating.

In still another principal aspect of the present invention, a method of forming a coated spray tip for a fluid spray nozzle comprises the steps of coating a spray tip blank with a colored coating and forming the spray tip orifice in the coated blank and through the coating after the coating has been applied.

In still another principal aspect of the present invention, a method of forming a coated spray tip for a fluid spray nozzle comprises the steps of applying a colored coating by printing the coating on a substantially flat face of the tip such that the coating is absent from the orifice of the spray tip.

In still another principal aspect of the present invention, in the last mentioned method, the orifice is formed in the face before the coating is printed upon the face and the coating image printed upon the face is free of coating at the orifice, but the coating is adjacent to the orifice.

In still another principal aspect of the present invention, a spray tip for a fluid spray nozzle having a spray orifice therein for metering and spraying fluid and a substantially flat exterior face thereon is provided. The improvement in such tip comprises a colored coating adhering to and covering the flat exterior face.

In still another principal aspect of the present invention, in the aforementioned spray tip the color of the coating denotes the flow rate of the spray tip.

In still another principal aspect of the present invention, in the last mentioned spray tips, the spray orifice is in the coated exterior face.

In still another principal aspect of the present invention, the exterior surfaces of the spray tip may be either completely coated or only partially coated so as to expose the material from which the tip is made to visual viewing.

In still another principal aspect of the present invention, the coating may be either an electrostatically deposited or a printed coating.

These and other objects, features and advantages of the present invention will become more readily understood upon a consideration of the following detailed description.

BRIEF DESCRIPTION OF THE DRAWINGS

In the course of this description, the drawings will be frequently referred to in which:

FIG. 5 is a cross-sectioned, side elevational view of the coated blank shown in FIG. 4, but in which the blank is in the process of being finally machined to include the spray orifice;

FIG. 6 is an enlarged, broken elevational view of the coated spray tip with the orifice having been formed therein;

FIG. 7 is an exploded view of a nozzle assembly in which a first embodiment of the spray tip of the present invention may form a component thereof;

FIG. 8 is a perspective view of the nozzle assembly shown in FIG. 7 in an assembled, ready for use condition;

FIGS. 9A, 9B and 9C depict sequential steps in the forming of a second printed embodiment of spray tip in accordance with the present invention;

FIG. 10 is an enlarged, perspective view of such second printed embodiment of spray tip which is shown being formed in FIGS. 9A–9C; and FIG. 11 is an enlarged, perspective view of still another embodiment of spray tip which has been coated in accordance with the present invention.

DESCRIPTION OF THE PREFERRED EMBODIMENTS

A first preferred embodiment of coated spray tip and method of forming such tip in accordance with the principles of the present invention is shown in FIGS. 1–8.

Figure 1:
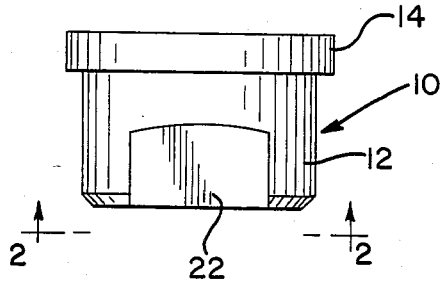
FIG. 1 is a side elevational view of a spray tip blank prior to application of the colored coating in accordance with the principles of the present invention.
Figure 3:
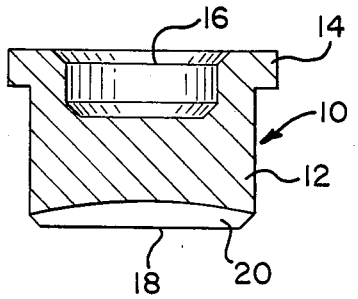
FIG. 3 is a cross-sectioned, side elevational view of the blank shown in FIG. 2, as viewed substantially along line 3—3 of FIG. 2.
Figure 2:
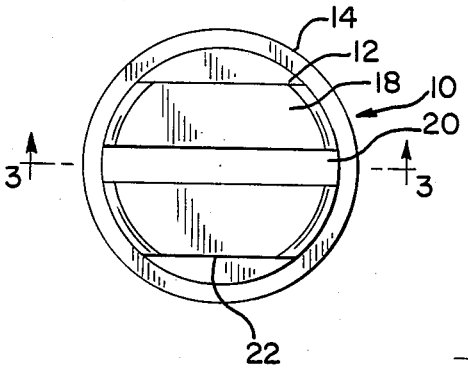
FIG. 2 is a bottom plan view of the blank, as viewed substantially along line 2—2 of FIG. 1.
Figure 4:
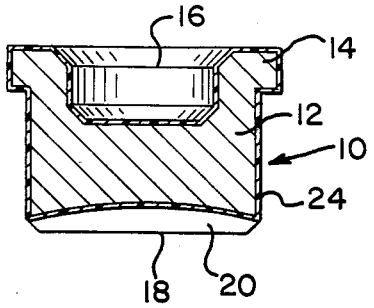
FIG. 4 is a cross-sectioned, side elevational view of the blank shown in FIG. 3 which has, however, been coated in accordance with the principles of the present invention.

In this embodiment a tip blank 10, as shown in FIGS. 1–3, is first formed of a base material metal commonly employed in the manufacture of such tips, e.g. brass, aluminum, mild or stainless steel. The blank generally comprises a body portion 12 having an enlarged shoulder 14 at one end, the latter of which is adapted to be clamped between a retainer ring of the nozzle body in which the tip is to be installed to retain the tip therein, as will be described in more detail hereinafter. The same end of the blank 10 also preferably includes a recess 16, as shown in FIGS. 3 and 4, which is machined into the blank for receiving the fluid to be sprayed from the tip. The opposite flat face 18 of the blank 10 may be machined to contain a slot 20 into which the orifice is ultimately located. The blank 10 may also be machined with wrench flats 22, if desired, as shown in FIGS. 1 and 2.

Once the metal blank is formed as shown in FIGS. 1–3, all of its exterior surfaces are then coated with a suitable coating 24 which firmly adheres to the exterior surfaces of the blank 10, as shown in FIG. 4. Such coating may comprise, for example, an epoxy coating. The selection of a suitable coating is within the skill of those in the art keeping in mind that the coatings should be capable of firmly bonding with the metal of the blank 10, be available in a wide range of colors to denote a wide range of nozzle flow rates, and be durable in use. Suitable coatings may include powder coatings of polyester, polyurethane or epoxy coatings which are available from, for example, Ferro Corporation. The thickness of the coating 24 may also vary. Thicknesses of between about 1½ mils to 5 mils have been found to be satisfactory. The coating 24 may be electrostatically or otherwise deposited on the blank 10 by well-known techniques.

Once the metal blank 10 has been coated with the coating 24, the final precision machining steps are preferably performed. As shown in FIG. 5, the coated blank 10 may be drilled with a radius point drill 26 to form the flow passage 28 to the orifice 30 and the orifice may be formed, by way of example, with a circular milling cutter 32, as shown in FIG. 5 to intersect the end of passage 28 and to form a "Vee" cut, as shown in FIG. 6. In this case the spray tip so formed will be a flat spray tip with a fan-shaped spray patternation. Thus, the close tolerance, high wear portions of the spray tip, e.g. the orifice 30, may be formed with precision and the base material metal in these portions of the spray tip is exposed by this machining operation following coating by removal of the coating to insure that no portion of the coating 24 impairs the precision orifice 30 of the spray tip.

Once the blank 10 has been finally machined to form the spray tip 34, the tip is ready to use. In use the spray tip 34 is inserted into and through a suitable retainer ring 36 in the nozzle assembly so that the tip projects beyond the retainer ring 36, as shown in FIG. 8. Assembly of the nozzle may be completed by inserting a suitable filter or strainer 38, as shown in FIG. 7, followed by threading of the nozzle body 40 itself into the retainer ring 36.

From the foregoing description, it will be seen that the coated spray tip 34 enjoys all the advantages previously enjoyed by an all metal spray tip and yet the flow capacity of the spray tip is easily and readily discernable upon visual examination of its colored coating by an observer. Moreover, because all close tolerance machining takes place after coating and the portions of the spray tip which must be of close tolerance are formed by removal of the coating and exposure of the metal in the final machining stages, fluid flow through the orifice 30 is not impaired or otherwise disrupted by the coating 24.

A second printed embodiment of spray tip and method of forming such tip is shown in FIGS. 9A–9C and 10. In this embodiment of spray tip, the colored coating 24 is applied to the spray tip 34' by printing the coating thereon. Again, the spray tip 34' is a flat tip which produces a fan-shaped patternation. The construction of the spray tip 34' of this embodiment is similar in many respects to the spray tip 34 previously described and where similarities exist, like reference numerals will be utilized to designate similar parts.

Conventional printing equipment may be employed in applying the coating 24' in this embodiment. Referring to FIG. 9A, the printing equipment 42 which is used to apply the coating may comprise a milled hardened steel plate 44 with the image 46 to be printed on the nozzle etched onto the plate. The image preferably includes a non-recessed area 48 which conforms with the slot 20 in the spray tip 34' to preclude coating of that slot and its orifice and, thereby, expose the base material at that location. It will be understood that if the slot is not present in the spray tip and, instead, the orifice is formed directly in the face 18 of the spray tip 34', the etched image 46 will be altered accordingly so long as a non-recessed portion remains in the image on the plate 44 to prevent coating of the slot.

In forming the printed embodiment of spray tip 34', the plate 44 is first coated by an applicator 50 with the ink 52 to be coated on the spray tip 34' as shown in FIG. 10. Following application of the ink to the plate 44, a doctor blade 54 is passed over the plate 44 to scrape clean all of the ink in excess on the surface of the plate 44, leaving the remainder of the ink in the etched recesses of the image 46. Again, the ink may be selected from any one of a number of suitable inks which will firmly adhere to the metal surfaces of the tip, such as, for example, epoxy inks.

At this time, a soft silicone rubber tampon 56, as shown in FIG. 9A, is pressed against the ink image on the plate so as to pick up the ink from the image onto the face of the tampon. The tampon 56 is then reciprocated or otherwise moved into an overlying position with the spray tip 34' which is to be coated, as shown in FIG. 9B. The image on the tampon 56 is then transferred to the face 18 of the spray tip 34' by pressing the tampon against the spray tip as shown in FIG. 9C.

Because the tampon 56 is soft, the ink image will not only be transferred to the generally flat face 18 of the spray tip 34', as shown in FIG. 10, to form a coating 24' thereon, but will also overlap the chamfered shoulder 58 on the spray tip and extend downward for some finite distance, but less than over all of the exterior surface of the sides of the spray tip, as shown in FIG. 10. This extension of the coating down over some, but less than all of the exterior surface of the spray tip 34', e.g. about one-eighth inch, is beneficial in at least two respects. In one respect, coating at least some of the side surfaces of the tip will allow for ready visual identification by the observer when the spray tip is installed in the nozzle assembly without having to get down and actually look at the face 18. By being able to identify the flow rate of the nozzle from its side profile, possible contamination of the observer by the fluid being sprayed is minimized. On the other hand, because the coating does not extend over the entire exterior surface of the spray tip, the nature of the base material metal from which the spray tip is formed is also visible and not completely obscured by the coating and, thereby, is also readily capable of visual recognition.

The printed spray tip and method of forming such spray tip enjoys several advantages in addition to the aforementioned advantages. One such additional advantage is that baking of the coating 24' may be avoided along with its increased energy requirements and heating equipment investment. Another advantage is that the thickness of the printed coating does not have to be as thick as in the first described embodiment. For example, coating thicknesses of as little as $\frac{3}{4}$ mil to 1 mil are satisfactory. Another advantage is that there is less of a tendency of the coating to flake or scale, as it might where the coating is subsequently disturbed by post-milling operations, as in the first embodiment. Still another advantage of the printed coating is realized during the machining of the spray tips. In the printed embodiment all machining may be performed prior to printing. Thus, the person performing the machining or milling is able to see at all times what the parent base metal is and any burrs which might be raised during machining of, for example, the orifice may be removed prior to printing, thereby, avoiding possible damage to or peeling of the printing coating. Still another advantage of the printing technique resides in the fact that metal spray tips which are already completely machined and in inventory may be updated by coating, whereas in the first described embodiment in which only the blank is coated, a substantial inventory of such blanks must be especially manufactured before final milling can be accomplished.

The principles of the invention are not limited to use in only the flat spray tips set forth in the foregoing description. Other types of spray tips may also incorporate the principles of the invention. Referring, by way of example to FIG. 11, a flooding nozzle tip 34'' is shown which has an orifice 60 in a lower portion of the tip. The fluid discharged from this orifice is directed against a curved deflection surface 62 from which it is discharged. The upper flat face 18' of this flooding tip does not include the orifice. However, it is this flat face which is coated by printing, as shown in FIGS. 9A–9C as previously described. It will be understood that tip 34" may also be coated, machined and mounted in the manner shown in FIGS. 1–8, if desired. The flat upper face of the tip 34", as shown in FIG. 11, may also include a screwdriver slot 64.

Although in the preceding description, the colored coatings have been described in terms of a single coating, additional partial coating layers may be applied either to the coating which has already been described or to other non-coated exterior surface areas of the tip. By way of example, an additional partial coating band may be applied to the coating 24 shown in FIG. 5 to denote other characteristics of the tip, such as its spray angle.

It will be understood that the preferred embodiments of the present invention which have been described are merely illustrative of only a few of the applications of the present invention. Numerous modifications may be made by those skilled in the art without departing from the true spirit and scope of the present invention.

What is claimed is:

1. A spray tip for a fluid spray nozzle, said tip being formed of a base material and having a spray orifice in a substantially flat exterior face thereon for metering and spraying the fluid, wherein the improvement in said tip comprises:

a colored coating printed on, adhering to and covering the base material of said flat exterior face, said base material of said tip being free of said coating at said spray orifice so that said orifice is not impaired by said coating.

2. The spray tip of claim 1, wherein the color of said coating denotes the flow rate of said spray tip.

3. The spray tip of claim 1, comprising a plurality of said spray tips, the coating of respective ones of said tips having differing colors denoting the flow rate of the respective ones of said tips.

4. The spray tip of claim 1, wherein said tip is metal and said colored coating is also adhered to other, but less than all of the exterior surfaces of said tip to expose the metal of said tip on portions of said tip other than said face.

5. The spray tip of claim 1, wherein said spray tip is metal and said coating is adhered to said metal.

6. A method of forming a coated spray tip for a fluid spray nozzle comprising the steps of:

forming a spray orifice in a substantially flat face of said spray tip, and subsequently applying a colored coating by printing a coating image which is free of said coating at said orifice on said substantially flat face of said tip such that the coating is absent from the spray orifice of the spray tip so that said orifice is not impaired by said coating.

7. The method of claim 6, wherein said tip is metal and said coating is applied to other, but less than all of the exterior metal surfaces of said tip to expose the metal of said tip on portions of said tip other than the coated portions.

8. The method of claim 6, wherein said spray tip is metal and said coating is adhered to said metal.

* * * * *